US008590228B2

(12) United States Patent
Esposito

(10) Patent No.: US 8,590,228 B2
(45) Date of Patent: Nov. 26, 2013

(54) CASING FOR OPENINGS OF BUILDINGS WITH ENHANCED THERMAL INSULATION CAPACITY

(75) Inventor: Giuseppe Esposito, Treviso (IT)

(73) Assignee: Axer S.R.L., Vicenza (IT)

( * ) Notice: Subject to any disclaimer, the term of this patent is extended or adjusted under 35 U.S.C. 154(b) by 0 days.

(21) Appl. No.: 13/518,664

(22) PCT Filed: Dec. 7, 2010

(86) PCT No.: PCT/IT2010/000488
§ 371 (c)(1),
(2), (4) Date: Aug. 7, 2012

(87) PCT Pub. No.: WO2011/077469
PCT Pub. Date: Jun. 30, 2011

(65) Prior Publication Data

US 2012/0317910 A1 Dec. 20, 2012

(30) Foreign Application Priority Data

Dec. 24, 2009 (IT) ..... VI2009A0309
Mar. 26, 2010 (EP) ..... 10425095

(51) Int. Cl.
*E06B 3/988* (2006.01)

(52) U.S. Cl.
USPC ..... 52/204.72; 52/204.591; 52/204.62; 52/204.593

(58) Field of Classification Search
USPC ..... 52/204.591, 204.593, 204.62, 204.71, 52/204.5, 209, 202, 786.1, 213, 235, 52/800.11, 302.3, 204.72
See application file for complete search history.

(56) References Cited

U.S. PATENT DOCUMENTS

| | | | | |
|---|---|---|---|---|
| 5,598,671 | A * | 2/1997 | Ting | 52/235 |
| 5,622,017 | A * | 4/1997 | Lynn et al. | 52/209 |
| 5,787,657 | A * | 8/1998 | Librande et al. | 52/202 |
| 6,055,783 | A * | 5/2000 | Guhl et al. | 52/204.62 |
| 6,463,706 | B1 * | 10/2002 | Guhl et al. | 52/204.62 |
| 6,530,184 | B1 * | 3/2003 | Emek | 52/204.591 |
| 6,635,093 | B1 * | 10/2003 | Schoen et al. | 44/553 |
| 6,889,480 | B2 * | 5/2005 | Guhl et al. | 52/786.1 |
| 7,293,391 | B2 * | 11/2007 | Guhl et al. | 52/204.593 |
| 7,518,583 | B2 * | 4/2009 | Lee et al. | 345/87 |
| 7,562,509 | B2 * | 7/2009 | Ness | 52/800.11 |
| 8,201,368 | B2 * | 6/2012 | Nirel et al. | 52/213 |

FOREIGN PATENT DOCUMENTS

| | | |
|---|---|---|
| CH | 496 153 | 9/1970 |
| DE | 2 129 779 | 12/1972 |
| EP | 1 207 264 A2 | 5/2002 |
| EP | 2 085 557 A2 | 8/2009 |
| GB | 2 065 207 A | 6/1981 |
| WO | WO 2006/079365 A1 | 8/2006 |

* cited by examiner

*Primary Examiner* — Chi Q Nguyen
(74) *Attorney, Agent, or Firm* — Abe Hershkovitz; Hershkovitz & Associates PLLC

(57) ABSTRACT

A casing for openings in buildings with enhanced thermal insulation capacity includes a first tubular section bar which is fixed to a perimetrical wall delimiting the opening, and a second tubular section bar cooperating with the first tubular section bar in order to hermetically close the opening. The first and second tubular section bars are capable of supporting one or more front panels of an interface between an inner environment and an outer environment of the building. At least one of the first tubular section bars and the second tubular section bars presents a plurality of through openings which create within at least one of the tubular section bars a continuous flow of circulating air which, due to the temperature difference between the inner environment and the outer environment, forms a natural thermal barrier in any season.

9 Claims, 2 Drawing Sheets

CASING FOR OPENINGS OF BUILDINGS WITH ENHANCED THERMAL INSULATION CAPACITY

BACKGROUND OF THE INVENTION (1) Field of the Invention

The present invention forms part of the building field and, more specifically, concerns a casing with enhanced thermal insulation capacity for openings, such as windows, doors, facades and the like, belonging to any building.

More precisely, the present invention concerns a casing with enhanced thermal insulation capacity of the so-called "closed-joint" type, that is provided with double gaskets positioned one on the outer side and one the inner side, in the ledge section bars of the casing.

The casing comprises welded or open tubular section bars, as well as a reference counter-frame and one or more finishing elements.

(2) Description of the Related Art

As known, there are, for a long time on the market of the field here, relevant casings or frames for closing openings of buildings which are able to keep, in a more or less effective manner, conditions of thermal insulation inside the environment delimited by the perimetrical walls in which the casing is mounted. Indeed, one of the main technical features required for the casings is a high thermal insulation capacity against atmospheric agents, such as air, wind, and water which inevitably affect the casings.

Moreover, another important property required for the casings is the capacity to acoustically isolate the environments or the rooms of buildings from noises coming from the outside, which noises may disturb the normal and customary work, recreational and/or relaxation activities of the people inside.

In addition to these prerogatives, the casings must however present other constructive features, such as allowing the entry of light in case they are of the type that can be opened and moved by the user without particular difficulties or hindrances. The casings must also have structural strength and non-deformability against the action of the atmospheric agents when subjected to continuous opening and closing cycles. The casings must also assure a perfect tightness in closing conditions and discourage or effectively prevent acts of vandalism.

The casing or frames made of wood are notoriously easy to build and present a remarkable capacity for thermal insulation, due to the inherent insulating properties of wood.

However, considering the increased requirements related to the sizes of the casings and, more in detail, the shape of the panels, especially if made of glass (which is more and more thick and heavy in order to assure adequate insulation and mechanical strength), when mounted on the perimetrical section bars, the casings are often made of wood and/or metallic material such as aluminium and/or steel, as well as wood and/or plastic material such as polyvinylchloride (PVC).

These casings for openings of buildings typically comprise a first tubular section bar made of metallic material, for instance steel, which is fixed to the perimetrical wall delimiting the opening, and a second metallic tubular section bar, cooperating with the first section bar in order to close the opening and supporting one or more front panels of an interface between the outer environment and the inner environment of a room inside a building.

The tubular section bars present good mechanical strength against the atmosphere agents, especially when used to support large glass slabs in casings of relevant sizes, by virtue of the structural strength and non-deformability afforded by the metallic material with which they are made.

Nevertheless, these metallic tubular section bars of the casings of the known type do not have the necessary thermal insulation characteristics.

In order to remedy such a problem, metallic casings have been proposed on the market for some years, commonly known in the field as "thermal break casings", which include an element made of low thermal conductivity material interposed between the outer tubular section bar and the inner tubular section bar. Such a thermally insulating element limits the heat transfer from the inner environment to the outside, thereby avoiding the formation of thermal bridges, usually along the perimeter of doors and windows.

On the other hand, the aforesaid thermal break casings present the recognized drawback of being subject to the so-called "bimetal effect": the outer tubular section bar and the inner tubular section bar, being at temperatures which differ from each other, inevitably suffer non-homogenous thermal expansions which cause dangerous deformations of the section bars themselves, especially if the bars are made of aluminium, since, as known, this material is an excellent heat conductor. This drawback limits at least partially significantly the air-tightness properties of the casings in closing conditions, thereby causing, on one hand, problems of heat dissipations, and on the other hand, phenomena of infiltration, responsible for the formation and proliferation of molds and other bacterial colonies. This drawback also causes a drastic reduction in the level of acoustic insulation of rooms inside the building.

The constructive solution nowadays widely adopted is the interposing of an insulating material element in a central section of the casings, between the two tubular section bars which compose it. This solution considerably reduces, therefore, the mechanical strength characteristics of the section bars in question.

One should not forget also that some plastic components present toxicity issues which arise during the process of welding the section bars. Welding is an essential process to assure section bars proper structural stability over time.

For the plastic components, in addition, pollution pollution issues arise relating to the disposal of working scraps and, last but not least, to the dismantling phase of the casing, at the end of the operating cycle.

Furthermore, in some cases, for the type of application to which they are intended, the tubular section bars of the casings should be properly subjected to a process of glazing by which, notoriously, a mechanical part is smoothed, deburred, polished and/or furbished.

In case of traditional thermal break casings, however, such a process of glazing cannot be completed since, by providing a significant pressure on the metallic tubular section bar, the process would seriously compromise the connection between the insulating material element and the tubular section bar.

German prior art document 2129779 discloses a casing for openings of buildings of the so-called "open-joint" type, wherein the outer tubular element, produced by aluminium drawing, presents a plurality of through openings simply having the aim to discharge water which accumulates or condensate which is produced inside the drawn tubular element.

BRIEF SUMMARY OF THE INVENTION

The present invention aims to overcome the drawbacks of the known technique mentioned above.

In particular, the main purpose of the invention is to provide a casing for openings in buildings. The casing keeps its own structural tightness characteristics unchanged over time or for a period of time definitely greater than that allowed by the casing of the known art.

Within this purpose, it is a first object of the present invention to create a casing for openings in buildings and to present a thermal insulation capacity better than that of the known casings.

It is a second object of the present invention to make available a casing for openings in buildings in which the improvement of the thermal insulation capacity compared to the current state of the art is achieved without compromising the properties of mechanical strength, robustness, safety against vandalism, cost and ease of fabrication and installation of the casing. It is another object of the invention to fabricate a casing for openings in buildings by a production process which, unlike the equivalent prior art, eliminates any problem of toxicity.

It is a further object of the present invention to design a casing for openings in buildings with a high level of acoustic insulation for the room where it is installed.

It is also an object of the invention to provide a casing which includes component elements on which it is possible to perform any processing or treatment of metallurgy, such as glazing.

It is a last but not least purpose of the present invention to develop a casing for openings in buildings to reduce, compared to the known art, the occurrence of condensation, avoiding the formation and proliferation of molds and/or bacteria and the phenomena of steaming up the surfaces of the glass slabs or panels housed inside one of the tubular section bars.

The aforesaid purposes are achieved by means of a casing with an enhanced thermal insulation capacity. Advantageously, the casing of the invention assures excellent tightness characteristics in application conditions, when closed, higher than those ones of equivalent casings of the known type, while keeping adequate mechanical properties, such as robustness and non-deformability, and allowing an easy and non-polluting recovery of the constituting steel, since the section bars are not mixed with plastic components which are more expensive and problematic, from the environmental impact point of view, to be separated therefrom.

At the same time, still advantageously, the casing of the invention offers a very effective thermal insulation, thanks to the presence of the through openings made in at least one of the two tubular section bars belonging to the casing.

Indeed, these through openings create a continuous flow of air which, due to the temperature difference between the inner environment and the outer environment, results in a constant movement of air within the chamber defined by each of the tubular section bars: this arrangement improves with respect to the known art the overall performances of the casing or frame, in terms of thermal insulation both in summer and winter. Moreover, in an advantageous manner, the continuous and upward airflow inside the chamber of at least one of the tubular section bars is a continuous thermal barrier which provides perimetrical ventilation along the seat or side wall of a housing for the front panel or slab, thus eliminating steaming up problems.

In substance, therefore, the through openings made in at least one of the two tubular section bars of the casing of the invention more specifically present a thermoregulating function for the inner room, thus scattering heat in a manner more efficient than what is allowed by known casings.

In the casing of the invention, the through openings have a thermoregulation result on the temperature and do not cause a discharging of the condensate or water, as happens in the device disclosed by German prior art document 2129779. To the contrary, the same through openings of the casing of the invention try to prevent or at least strongly limit the appearance of such a phenomenon.

Equally advantageously, the casing of the invention involves a saving of components and materials in comparison to similar casings of the known technique, thereby reducing costs, with the other factors being equal.

BRIEF DESCRIPTION OF THE DRAWINGS

The aforesaid purposes and advantages, as well as others that will emerge later on, will appear more from the following description relating to a preferred embodiment of the casing with enhanced thermal insulation capacity, given by illustrative and indicative examples, but not limited to the attached drawings, where.

DETAILED DESCRIPTION OF THE INVENTION

Figure 1:
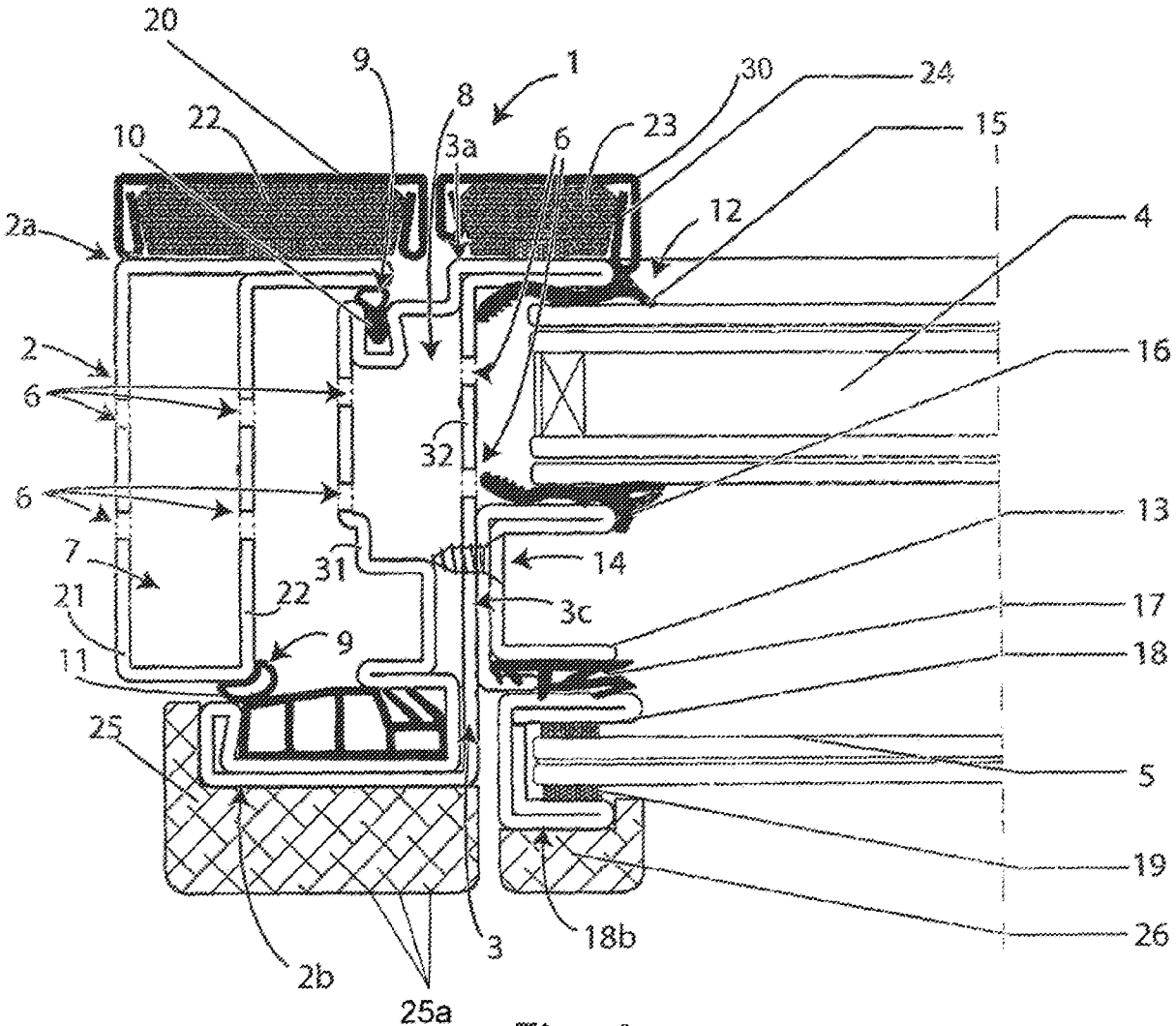
FIG. 1 is a cross section view of the casing of the invention.

The casing 1 for openings in buildings with enhanced thermal insulation capacity is illustrated in a first embodiment in FIG. 1.

As can be seen, the casing 1 includes a first tubular section bar 2, which is fixed to the perimetrical wall delimiting the opening, and a second tubular section bar 3, cooperating with the first section bar 2 in order to hermetically close the opening and supporting in this case a pair of front panels 4, 5 of an interface between the outer environment and the inner environment of the building.

According to the invention, the first section bar 2 and the second section bar 3 present a plurality of through openings 6 which create within each of them a continuous flow of circulating air which, due to the temperature difference between the inner environment and the outer environment, forms a natural thermal barrier in any season.

In practice, therefore, each of the tubular section bars 2, 3 defines a respective inner chamber 7, 8 communicating with the surrounding environment by means of the through openings 6 and in which the continuous flow of air forms said natural thermal barrier.

In particular, the aforesaid continuous flow of air is of an upward kind.

The through openings 6 are made with special geometry, pace and sequence, as well as asymmetrically along two prefixed sections 21, 22 and 31, 32 opposite and facing each other of the tubular section bars 2, 3.

Preferably but not necessarily, each of the through openings 6 has a closed slot-shaped perimetrical profile.

FIG. 1 shows that, in this specific case, the first section bar 2 presents in cross section a substantially L-shaped profile, while the second section bar 3 presents, always in cross section, a substantially Z-shaped profile.

It is understood that, in other embodiments of the invention, not illustrated, the first tubular section bar 2 as well as the second section bar 3 will present in cross section a profile different from that one just described: for example, the first section bar 2 will present a substantially T-shaped or Z-shaped profile, while the second section bar 3 will present a substantially L-shaped or T-shaped profile.

More specifically, the tubular section bars 2, 3 are made of metallic material, e.g. steel or any alloy thereof.

In a preferred but not binding way, the casing 1 comprises first sealing means 9, interposed between the first tubular section bar 2 and the second tubular section bar 3.

More in detail, the first sealing means 9 include a pair of shaped strike seals 10, 11, not visible from the outside and placed close to the inner part of the tubular section bars 2, 3 from mutually opposite parts. Preferentially, the casing 1 also includes second sealing means 12, interposed between the second tubular section bar 3 and the front panels 4, 5 and between each of the latter and an auxiliary separation section bar 13, coupled through fastening means 14, with a side wall 3*c* of the second section bar 3 and interposed between the front panels 4, 5.

The second sealing means 12, of the type in itself known to the person skilled in the art, comprise, for example, a plurality of shaped seals 15, 16, 17; in particular, the shaped seal 15 is interposed between the second tubular section bar 3 and the front panel 4, the shaped seal 16 is interposed between the auxiliary separation section bar 13 and a support section bar 18 which houses the front panel 5 through the interposition of an additional gasket or sponge 19 made for example of silicone.

The casing 1 includes a pair of covering elements 20, 30, containing therein respective layers of insulating material 22, 23 externally coupled with outer portion 2*a*, 3*a* of the tubular section bars 2, 3 through first gluing means 24, as well as a pair of shaped bodies made of insulating material 25, 26, internally coupled with an inner portion 2*b* of the tubular section bar 2 and, in this case, an inner part 18*b* of the support section bar 18 through second gluing means, not shown for simplicity.

It is understood that, in further embodiments of the invention, not represented, the casing 1 may include only one covering element 20 or 30, arranged externally close to the outer portion 2*a* or 3*a* of one of the tubular section bars 2 or 3, respectively.

In addition, one other embodiment of the casing 1 of the invention, still not shown hereafter, will provide more than one covering element 20, 30 for each of the tubular section bars 2,3.

Figure 2:
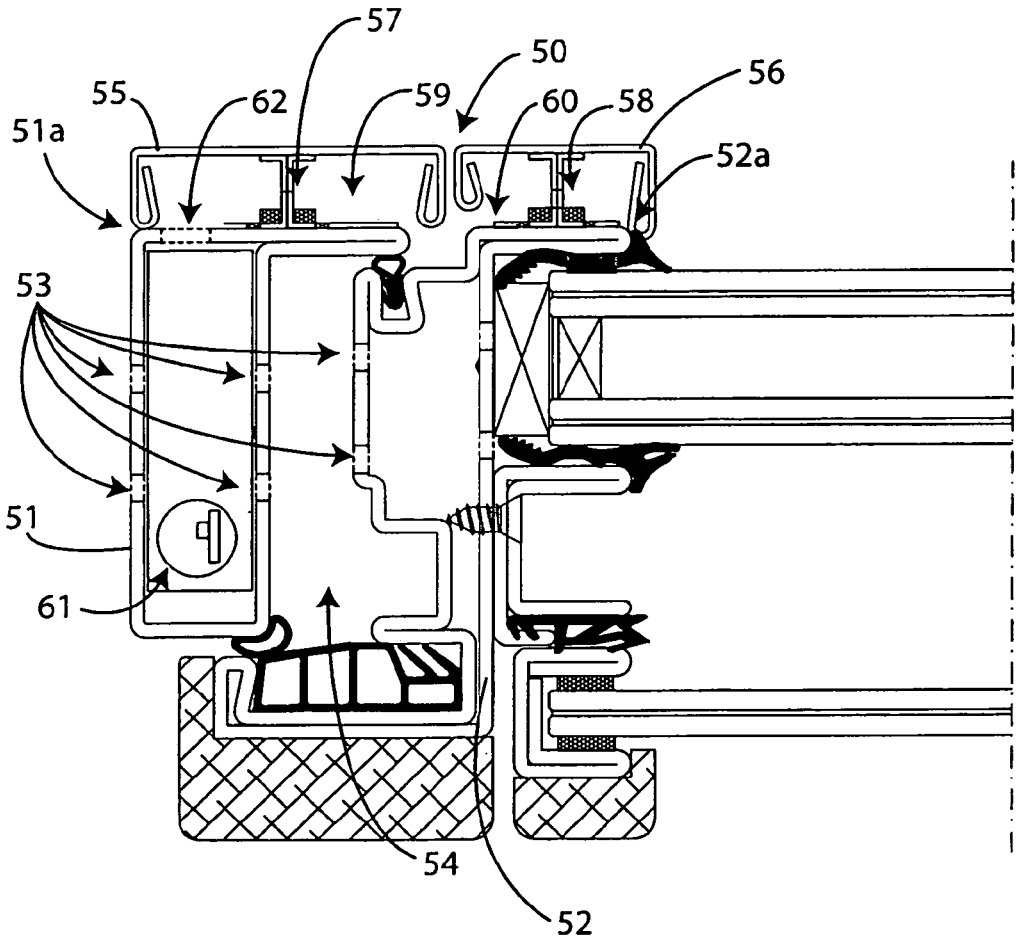
FIG. 2 is a variant of the casing of FIG. 1.

FIG. 2 shows a possible execution variant of the invention in which a casing 50 differs from the casing 1 just described firstly for the constructive composition of covering elements 55, 56.

Indeed, in this case, the two covering elements 55, 56 are placed firmly and externally close to outer portions 51*a*, 52*a* of tubular section bars 51, 52 respectively, without the interposition of the layer of insulating material, as in the sample of the casing 1 previously described.

In this regard, the casing 50 comprises a first punched spacer 57, placed between the outer portion 51*a* of the tubular section bar 51 and the covering element 55 in order to determine the support thereof, thus creating a first interstitial air zone 59 communicating with the outside.

Similarly, although in a preferred but not binding way, the covering element 56 is supported by a second punched spacer 58 which creates a second interstitial air zone 60 between the outer portion 52*a* and the covering element 56 itself.

Another important technical feature which differentiates the casing 50 of FIG. 2 from the casing 1 of FIG. 1 consists in the fact that the casing 50 includes forced ventilation means 61, suitable to create an air recirculation between the outer environment and the inner environment, placed inside the tubular section bar 51 and communicating by means of through openings 53 with a central compartment 54 defined between the tubular section bars 51 and 52. The forced ventilation means 61, including for example a fan of the type in itself known, communicate also by means of a through slit 62, made in the outer portion 51*a* of the tubular section bar 51, with the first interstitial air zone 59 defined between the outer portion 51*a* of the tubular section bar 51 and the covering element 55.

Unlike the known technique, the constructive aspect just described allows an owner to keep hidden and protected from accidental impacts, atmospheric agents and/or dust of various kinds, in application conditions, the forced ventilation means 61. This means 61 affects the functional efficiency of the invention, thus assuring an improvement in the aesthetic effect offered by the casing 50 as a whole.

In further embodiments, the casing 50 of the invention may include forced ventilation means 61 in both the tubular section bars 51 and 52, assuming as a consequence the presence of the through slit 62 in the outer portion 51*a* and 52*a* of each of the tubular section bars 51 and 52, respectively.

In addition, in other embodiments, not illustrated in the appended drawings, the casing 50 of the invention may include more than one punched spacer 57 or 58 between at least one of the covering elements 55 or 56 and the outer portion 51*a* or 52*a* of the relative tubular section bar 51 or 52, respectively.

In alternative embodiments of the invention, not shown, the casing 1 or 50 for openings in buildings with enhanced thermal insulation capacity could comprise a reference counter-frame, suitable to be contained within the perimetrical wall which delimits the opening and against which the first tubular section bar 2 or 51 rests, and/or at least one surface finishing element 25, coupled with the inner and/or outer wall of the second tubular section bar 3 or 52. Even the reference counter-frame and/or the at least one surface finishing element could present one or more through aeration holes 25*a*.

On the basis of what was just described, it is, then, understood that the casing 1 or 50 for openings in buildings with enhanced thermal insulation capacity, which is the object of the invention, achieves the purposes and the advantages mentioned above.

In execution phase, changes can be made to the casing 1 or 50 for openings in buildings with enhanced thermal insulation capacity. For example, in a number of through openings different from the openings 6 and 53 mentioned above and illustrated in the attached drawings, this number could vary from one, depending on application needs.

Other embodiments, not shown, of the casing 1 or 50 may exist, in which only one of the two tubular section bars 2, 3 or 51, 52 belonging to the casing 1 or 50 presents one or more through openings 6 or 53 for the passage of air whose continuous flow and turbulence create the natural thermal barrier, which does not affect the advantages brought by the present invention. It is clear that numerous other variations can be made to the casing 1 or 50 for openings in buildings without departing from the novelty principles inherent in the inventive idea expressed herein, as it is clear that, in the practical implementation of the invention, materials, shapes and sizes of the illustrated details can be any, as needed, and replaced with others.

The invention claimed is:

1. A casing for an opening in a building with enhanced thermal insulation capacity, comprising:

a first tubular section bar made of metallic material, suitable for being fixed to a perimetrical wall which delimits said opening, a second tubular section bar made of metallic material, which cooperates with said first tubular section bar in order to close said opening and supports one or more front panels of an interface between an outer environment and an inner environment of said building, one or more covering elements, placed firmly and externally close to an outer portion of at least one of said tubular section bars, and one or more shaped bodies made of insulating material coupled with an inner portion of at least one of said tubular section bars, wherein at least one of said tubular first section bar and said second tubular section bar presents one or more through openings which create within at least one of said tubular section bars a continuous flow of circulating air which, due to a temperature difference between said inner environment and said outer environment, forms a natural thermal barrier in any season, first sealing means interposed between said first tubular section bar and said second tubular section bar, at least one punched spacer interposed between said outer portion of at least one of said tubular section bars and at least one of said covering elements, thus creating an interstitial air zone communicating with the outer environment, forced ventilation means, suitable to create an air recirculation between said inner environment and said outer environment, placed inside at least one of said tubular section bars and communicating by means of said through openings with a central compartment defined between said tubular section bars and by means of a through slit, made in said outer portion of at least one of said tubular section bars, with said interstitial air zone defined between said outer portion of at least one of said tubular section bars and at least one of said covering elements, and at least one surface finishing element, coupled with the inner and outer portions of said second tubular section bar, said at least one surface finishing element having one or more through aeration holes.

2. The casing as claimed in claim 1 wherein each of said tubular section bars defines an inner chamber which communicates with a surrounding environment through said through openings and in which said continuous flow of air forms said natural thermal barrier.

3. The casing as claimed in claim 1 wherein said continuous flow of air is of an upward type.

4. The casing as claimed in claim 1 wherein said through openings are made asymmetrically along two prefixed sections opposite and facing each other of at least one of said tubular section bars.

5. The casing as claimed in claim 1 wherein each of said through openings presents a closed slot-shaped perimetrical profile.

6. The casing as claimed in claim 1 wherein said first tubular section bar presents in cross section a profile substantially in a form of one of an L, T, and Z.

7. The casing as claimed in claim 1 wherein said second tubular section bar presents in cross section a profile substantially in a form of one of a Z, L, and T.

8. The casing as claimed in claim 1 wherein said first sealing means comprise a pair of gaskets, arranged close to said tubular section bars.

9. The casing as claimed in claim 1 further comprising second sealing means interposed between said second tubular section bar and said front panels and also interposed between each of said front panels and an auxiliary separation element coupled through fastening means with said second tubular section bar.

* * * * *

UNITED STATES PATENT AND TRADEMARK OFFICE

CERTIFICATE OF CORRECTION

PATENT NO. : 8,590,228 B2
APPLICATION NO. : 13/518664
DATED : November 26, 2013
INVENTOR(S) : Giuseppe Esposito It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 2 days.

Signed and Sealed this
Twenty-second Day of September, 2015

Michelle K. Lee

Michelle K. Lee
*Director of the United States Patent and Trademark Office*